US010914026B2

(12) United States Patent
Uros

(10) Patent No.: US 10,914,026 B2
(45) Date of Patent: Feb. 9, 2021

(54) DOOR LOCK FOR HOME APPLIANCE WITH HOOK SENSING MECHANISM

(71) Applicant: ILLINOIS TOOL WORKS INC., Glenview, IL (US)

(72) Inventor: Milost Uros, Nova gorica (SI)

(73) Assignee: Illinois Tool Works Inc., Glenview, IL (US)

( * ) Notice: Subject to any disclaimer, the term of this patent is extended or adjusted under 35 U.S.C. 154(b) by 505 days.

(21) Appl. No.: 15/313,563

(22) PCT Filed: Mar. 11, 2015

(86) PCT No.: PCT/US2015/019827
§ 371 (c)(1),
(2) Date: Nov. 23, 2016

(87) PCT Pub. No.: WO2015/187223
PCT Pub. Date: Dec. 10, 2015

(65) Prior Publication Data

US 2017/0211221 A1 Jul. 27, 2017

(30) Foreign Application Priority Data

Jun. 3, 2014 (IT) ..... 2014A0444

(51) Int. Cl.

| | |
|---|---|
| ***D06F 37/28*** | (2006.01) |
| ***D06F 39/14*** | (2006.01) |
| ***E05B 47/06*** | (2006.01) |
| *E05B 47/00* | (2006.01) |

(52) U.S. Cl.
CPC ..... *D06F 37/28* (2013.01); *D06F 39/14* (2013.01); *E05B 47/06* (2013.01); *E05B 2047/0069* (2013.01)

(58) Field of Classification Search
CPC ..... D06F 37/28; D06F 39/14; D06F 37/42; E05B 47/06; E05B 47/0603; E05B 2047/0069; E05B 47/0607; Y10S 292/69
See application file for complete search history.

(56) References Cited

U.S. PATENT DOCUMENTS 5,520,424 A * 5/1996 Hapke ..... E05B 47/0607 292/198
2004/0140677 A1* 7/2004 Hengelein ..... D06F 39/14 292/201

(Continued)

FOREIGN PATENT DOCUMENTS

DE 102006058322 A1 6/2008
DE 112013001248 B4 5/2017

(Continued)

OTHER PUBLICATIONS

ISR and WO for PCT/US2015/019827 dated May 12, 2015.
Search Report dated Nov. 21, 2014 in Italian Application No. TO2014A000444.

*Primary Examiner* — Alyson M Merlino
(74) *Attorney, Agent, or Firm* — Boyle Fredrickson, S.C.

(57) ABSTRACT

A door-lock for household appliances, comprising:

a casing having an opening through which it is intended to be inserted a hook connected to the door of the appliance, a cam articulated to the casing and rotatable between an open door position and a closed door position, wherein the insertion of the hook in the casing rotates the cam from the open door position to the closed door position, a locking mechanism including a locking pin movable between an unlocking position and a locking position, a main switch switchable between an open position and a closed position, wherein said locking pin in the unlocking position prevents the closure of the main switch, and (Continued)

a hook sensing mechanism including a hook sensing pin movable between a disengaged hook position and an inserted hook position, wherein said hook sensing pin cooperates directly with said main switch and prevents the closure of the main switch in the disengaged hook position.

6 Claims, 4 Drawing Sheets

(56) References Cited

U.S. PATENT DOCUMENTS

2010/0077803 A1* 4/2010 Lim ..... D06F 37/28 68/212
2010/0117378 A1* 5/2010 Seo ..... D06F 39/14 292/163
2012/0119522 A1* 5/2012 Bauriedl ..... E05B 47/0603 292/228
2015/0021927 A1* 1/2015 Wang ..... D06F 37/42 292/99
2015/0225886 A1* 8/2015 Rocchitelli ..... D06F 37/28 292/38
2016/0160535 A1* 6/2016 Haidvogl ..... E05B 47/0607 312/212

FOREIGN PATENT DOCUMENTS

| | | | |
|---|---|---|---|
| EP | 1433893 | A2 | 6/2004 |
| FR | 2930953 | A1 | 11/2009 |
| WO | 2013109585 | A2 | 7/2013 |
| WO | 2013181289 | A1 | 12/2013 |

* cited by examiner

DOOR LOCK FOR HOME APPLIANCE WITH HOOK SENSING MECHANISM

FIELD OF THE INVENTION

The present invention relates to a door-lock for household appliances such as washing machines, washer-dryer, dryers.

BACKGROUND OF THE INVENTION

A door-lock has the purpose of ensuring that the door of a household appliance is locked in the closed position and can be opened only after the end of an operating cycle. In many cases, in addition to the locking function, the door-lock device is also equipped with a door sensing mechanism, adapted to detect the presence of the hook of the door. The purpose of this mechanism is to prevent the start of the appliance when the hook of the door is not properly inserted into the door-lock.

In the solutions present on the market the door-lock comprises an electromagnet which controls a locking pin. The locking pin is adapted to lock in a retaining position a cam that engages the hook of the door. The locking pin cooperates with a main switch which directly drives the motor of the appliance. The main switch is closed when the cam is locked in the retaining position.

The door lock can also be provided with a hook sensing mechanism that includes a safety slider and a door sensing pin that opens a door sensing switch when the hook of the door is not correctly engaged with the door-lock. The door sensing switch is connected to an electronic circuit which controls the electromagnet and activates the locking/unlocking functions. When the door sensing switch is open, the electronic circuit controls the electromagnet which in turn opens the main switch and prevents starting of motor of the household appliance.

The problem with this solution is that in the event of malfunction of the electronic circuit the appliance could operate with the door open.

OBJECT AND SUMMARY OF THE INVENTION

The object of the present invention is to provide a door-lock with hook sensing mechanism that overcomes the problems of the prior art.

According to the present invention this object is achieved by a door-lock having the characteristics forming the subject of Claim 1.

The claims form an integral part of the teaching given in relation to the invention.

BRIEF DESCRIPTION OF THE DRAWINGS

The present invention will now be described in detail with reference to the accompanying drawings, given purely by way of non-limiting example, in which.

DETAILED DESCRIPTION

Figure 1:
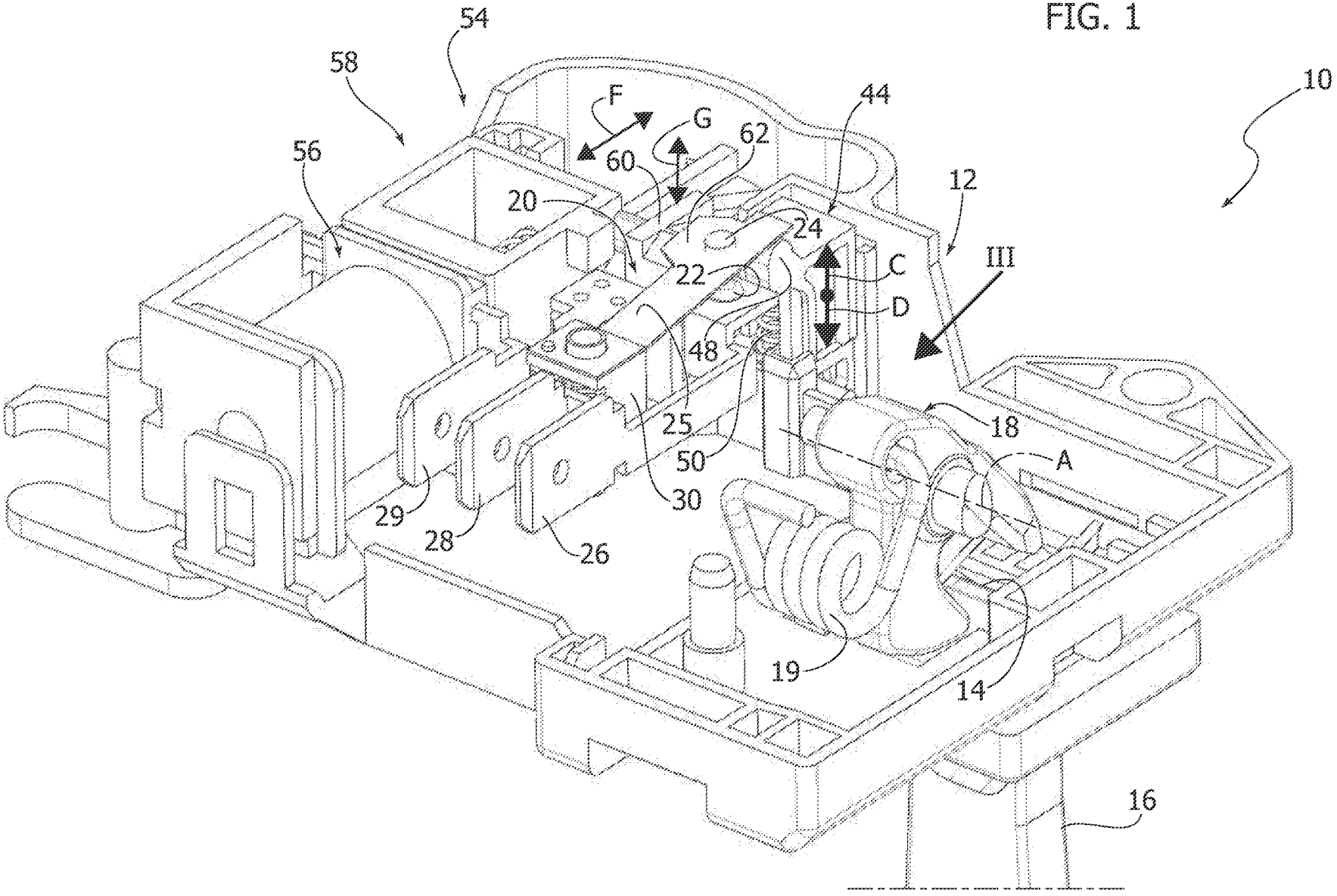
FIGS. 1 and 2 are perspective views showing some components of a door-lock according to the present invention, respectively in the unlocked position and the locked position.
Figure 2:
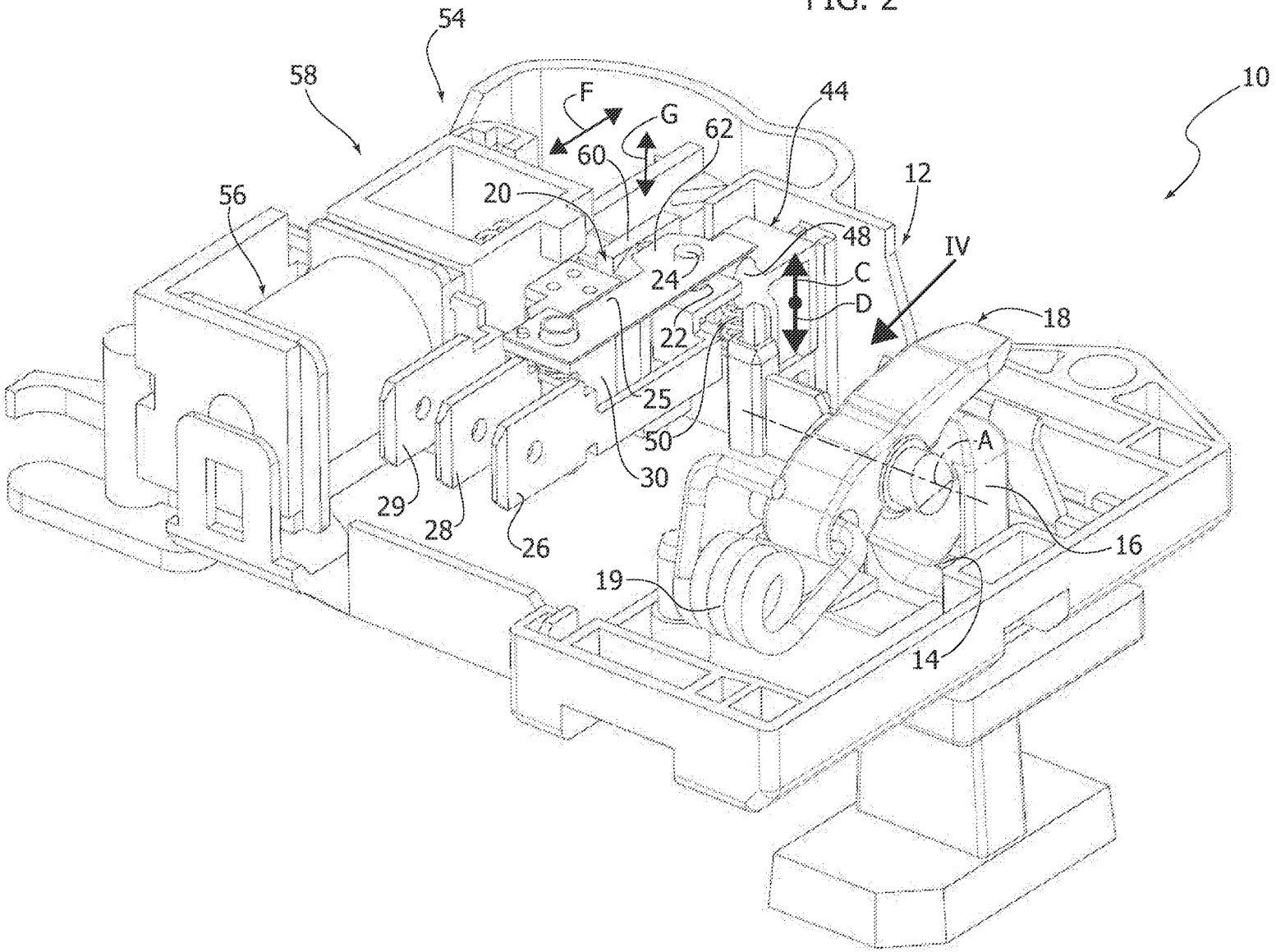

With reference to FIGS. 1 and 2, the reference 10 indicates a door-lock for household appliances according to the present invention. The door-lock 10 comprises a casing 12 having an opening 14 through which is intended to be inserted a hook 16 connected to a door (not shown) of a household appliance. The hook 16 is movable relative to the housing 12 in a rectilinear direction between an open door position shown in FIG. 1 and a closed door position shown in FIG. 2.

The door-lock 12 includes a cam 18 rotatable relative to the casing 12 around an axis A between an open door position shown in FIG. 1 and a closed door position shown in FIG. 2. The cam 18 is associated with an elastic element 19 that holds the cam 18 in a stable manner in the locked position or in the unlocked position. On closing the door, hook 16 engages the cam 18, which swings from the open door position to the closed door position.

The door-lock 10 is provided with a locking mechanism 54 adapted to lock the cam 18 in the closed door position illustrated in FIG. 2. Lock mechanism 54 can be realized according to solutions known in the art. An example of a locking mechanism is described for example in Italian patent application TO2012A000469 by the same Applicant. The locking mechanism 54 comprises an electromagnet 56 associated to a control member 58 which is movable in a rectilinear direction F. The control member 58 actuates a locking pin 60 which is movable in a rectilinear direction G between an unlocking position and a locking position. In the locking position the lock pin 60 locks a slider (not shown) which in turn locks the cam 18 in the closed door position. When the cam 18 is locked in the closed door position it cannot rotate around the axis A from the closed door position towards the open door position and prevents disengagement of the hook 16.

The door-lock 10 comprises a main switch 20 comprising a fixed electric contact 22, a movable electric contact 24 and three electrical terminals 26, 28, 29. The electrical terminals 26, 28 are connected to an electric motor that drives the appliance.

In the illustrated example, the movable electric contact 24 is formed at a distal end of a flexible metal blade 25, fixed at a proximal end to a base 30 to which is connected the second electrical terminal 28. The first electrical terminal 26 is preferably in one piece with the fixed electric contact 22.

When the movable electric contact 24 is detached from the fixed electric contact 22, the electrical connection between the terminals 26, 28 is interrupted. In this condition the start of the appliance is prevented. When the movable electric contact 24 is in contact with the fixed electric contact 22 the electrical connection between the terminals 26, 28 is closed and the electric motor of the appliance can be started. The elasticity of the metal blade 25 tends to keep the movable electric contact 24 in contact with the fixed electric contact 22.

The locking pin 60 cooperates with an appendix or tab 62 of the flexible blade 25. When the locking pin 60 is in the unlocking position (FIG. 1) it engages the tab 62 and maintains the flexible blade 25 in a deformed condition in which the movable electric contact 24 is separated from the fixed electrical contact 22. In this condition the main switch 20 is open and the appliance cannot be started. When the locking pin is in the locking position (FIG. 2) the flexible blade 25 holds the movable electric contact 24 in contact with the fixed electric contact 22. In this condition the main switch 20 is closed and the appliance can be started.

Figure 3:
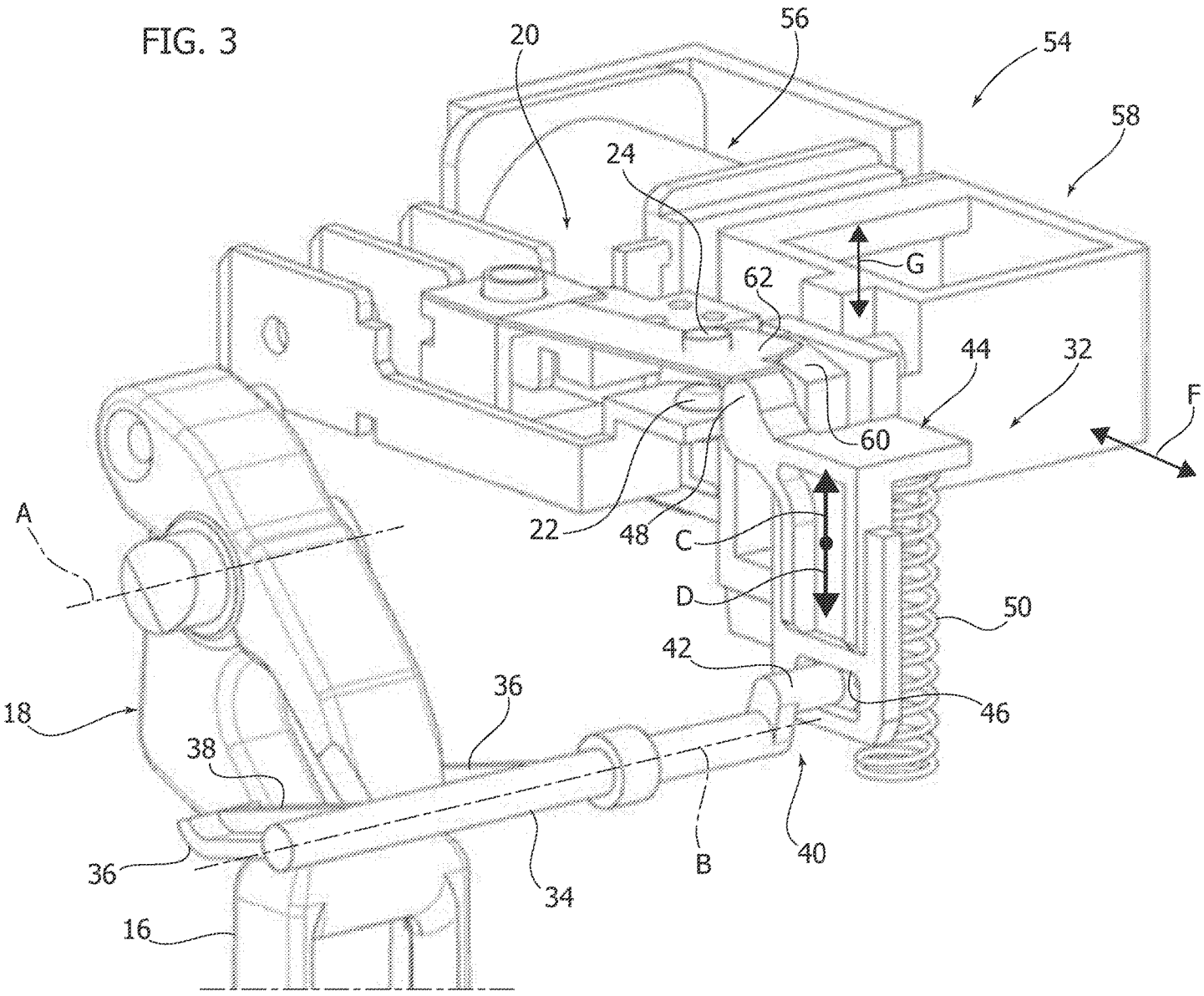
FIGS. 3 and 4 are perspective views of the door sensing mechanism, respectively according to arrows III and IV of FIGS. 1 and 2.
Figure 4:
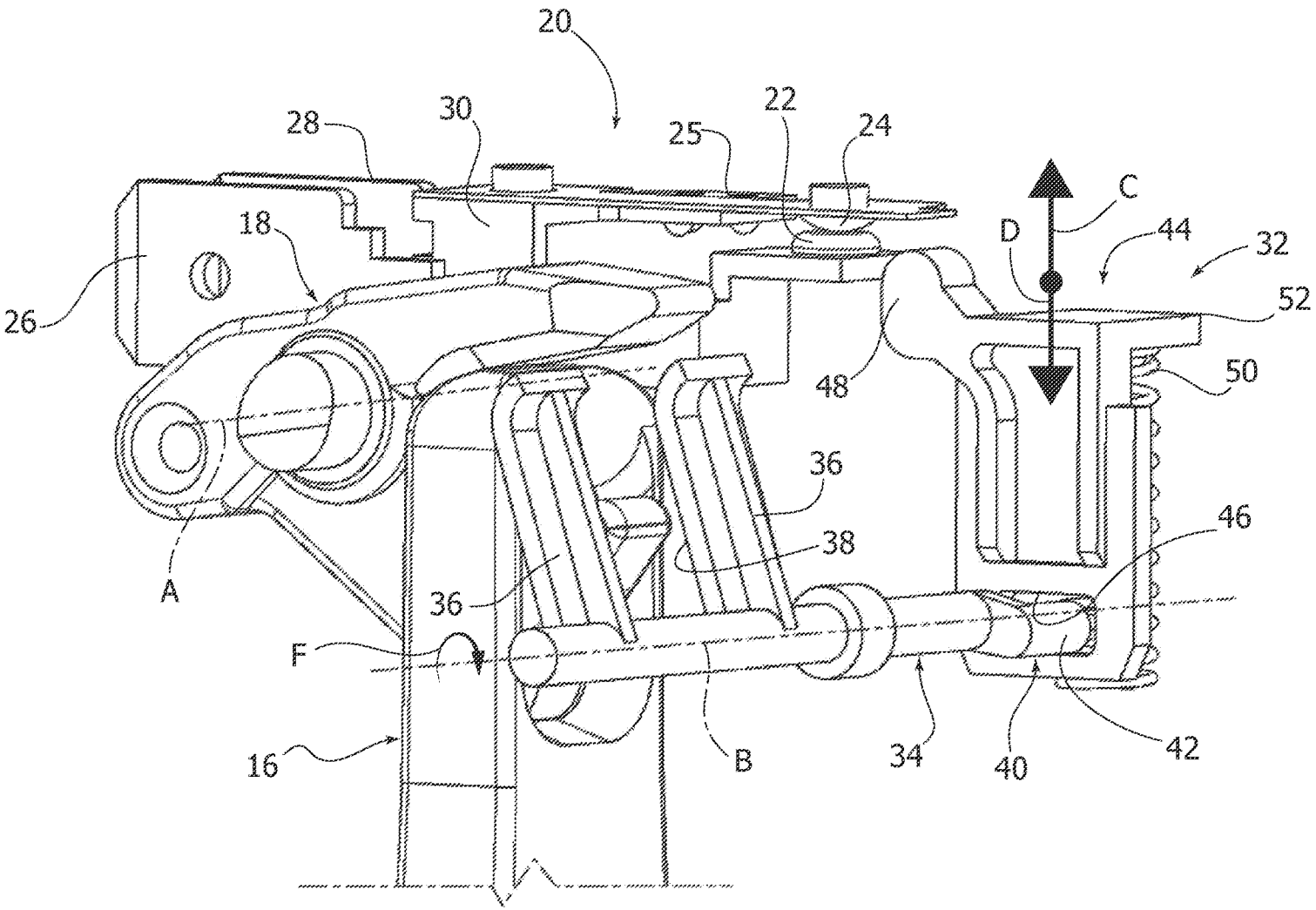

With reference to FIGS. 3 and 4, the door-lock 10 comprises a hook sensing mechanism 32. The hook sensing mechanism 32 includes a shaft 34 which is rotatably carried by the casing 12 around an axis B. In the shown example the B-axis is parallel to the axis A. The shaft 34 has at least one arm 36 protruding radially from the shaft 34. In the shown example the shaft 34 has two radial arms 36, preferably formed in one piece with the shaft 34. The radial arms 36 are spaced apart in the direction of the axis B, so as to form a slot 38 through which the cam 18 is freely movable. The two arms 36 are arranged on opposite sides of the cam 18 and are intended to rest on the hook 16. At one end of the shaft 34 is arranged a crank 40 including an eccentric pin 42 having an axis spaced in a radial direction from the axis B of the shaft 34.

The hook sensing mechanism 32 comprises a hook sensing pin 44 which is movable relative to the housing 12 along a straight direction orthogonal to the axis B, indicated by the arrows C, D in FIGS. 3 and 4. The hook sensing pin is guided in the direction C, D in a seat formed integrally in the casing 12. The hook sensing pin 44 has a slot 46 elongated in a direction orthogonal to the direction C, D, in which is engaged the eccentric pin 42 of the shaft 34. The hook sensing pin 44 has a portion 48 which is intended to contact a distal end of the metal blade 25. An elastic element 50 is set between a wall 52 of the hook sensing pin 44 and the casing 12 and tends to push the hook sensing pin 44 in the direction indicated by the arrow C. The force of the elastic element 50 is greater than the elastic force of the blade 25 that tends to keep the movable contact 24 pressed against the fixed contact 22.

In the open door position the hook 16 is disengaged from the cam 18 as shown in FIGS. 1 and 3. In this condition, the elastic element 50 pushes the hook sensing pin 44 in the direction indicated by arrow C in FIG. 3. In this condition, the portion 48 of the hook sensing pin elastically deforms the plate 25 and maintains the movable contact 24 separate from the fixed contact 22. In the position shown in FIG. 3 the cam 18 is in the open door position and the axis of the eccentric pin 42 is shifted in the direction C with respect to the axis B of the shaft 34. In this condition the switch 20 is open and prevents the start of the appliance.

FIGS. 2 and 4 show the closed door position. The hook 16 is inserted within the casing 12. The cam 18 engages the hook 16 and is rotated around the axis A in the closed door position. During the insertion within the casing 12, the hook 16 contacts the arms 36 and rotates the shaft 34 about axis B in the direction indicated by the arrow F in FIG. 4. Rotation of the shaft 34 in the direction F moves the hook sensing pin 44 in the direction indicated by the arrow D. As a matter of fact, the eccentric pin 42 acts on the lower wall of the groove 46 and pushes the cursor 44 in the direction indicated by arrow D against the thrust of the elastic element 50. Portion 48 of the cursor 44 disengages from the blade 25, which returns to its rest position shown in FIG. 4, in which the movable contact 24 is pressed against the fixed contact 22. In this condition the switch 20 is closed and the appliance can be started.

The door sensing mechanism 32 has a safety function, especially for situations where hook 16 breaks or cam 18 is rotated by a finger. As a matter of fact, the cam 18 may be rotated to the lock position even in the absence of the hook 16 due to a breakage of the hook 16 or if pushed by a finger or an object inserted through the opening 14 of the casing 12. The hook sensing mechanism 32 ensures that the main switch 20 is always open when the hook 16 is not inserted in the casing 12, even if the cam 18 is rotated in the lock position. Because the detection mechanism of the hook 32 acts directly on the main switch, the opening of the main switch is ensured even in case of failure to the electronic circuit which controls the electromagnet.

The hook sensing mechanism 32 is independent of the lateral position of the hook 16, which entails fewer problems of failures.

Of course, without prejudice to the principle of the invention, the details of construction and the embodiments may vary widely with respect to those described and illustrated without departing from the scope of the invention as defined by the claims that follow.

The invention claimed is:

1. A door-lock for a household appliance, the door-lock comprising:

a casing having an opening through which a hook connected to a door of the household appliance can be inserted, a cam articulated to the casing and rotatable between an open door position and a closed door position, wherein insertion of the hook into the casing rotates the cam from the open door position to the closed door position, a main switch switchable between an open position and a closed position, a locking mechanism including a locking pin selectively engaging the main switch, the locking pin movable between:

an unlocking position defined when the locking mechanism is unlocked and the locking pin engages the main switch to prevent closure of the main switch to the closed position; and a locking position defined when the locking mechanism is locked and the locking pin is disengaged from the main switch to allow closure of the main switch to the closed position; and a hook sensing mechanism including a hook sensing pin selectively engaging the main switch, the hook sensing pin movable between:

a disengaged hook position defined when the hook is not inserted into the casing and the hook sensing pin engages the main switch to prevent closure of the main switch to the closed position; and an inserted hook position defined when the hook is inserted into the casing and the hook sensing pin is disengaged from the main switch to allow closure of the main switch to the closed position, wherein the locking pin and the hook sensing pin are independent from each other so that:

closure of the main switch to the closed position is prevented when either:

the locking pin is in the unlocking position and engages the main switch independent of a position of the hook sensing pin, or the hook sensing pin is in the disengaged hook position and engages the main switch independent of a position of the locking pin, and closure of the main switch to the closed position can only occur when both:

the locking pin is in the locking position and is disengaged from the main switch, and the hook sensing pin is in the inserted hook position and is disengaged from the main switch.

2. A door-lock according to claim 1, wherein the main switch comprises a fixed electric contact and a movable electric contact carried by a flexible blade, wherein the locking pin, when in the unlocked position, and the hook sensing pin, when in the disengaged hook position, both act on the flexible blade to prevent contact between the movable electric contact and the fixed electric contact, thereby preventing closure of the main switch to the closed position.

3. A door-lock for a household appliance, the door-lock comprising:

a casing having an opening through which a hook connected to a door of the household appliance can be inserted;

a cam articulated to the casing and rotatable between an open door position and a closed door position, wherein insertion of the hook into the casing rotates the cam from the open door position to the closed door position, a locking mechanism including a locking pin movable between an unlocking position and a locking position;

a main switch switchable between an open position and a closed position, wherein the locking pin, when in the unlocking position, prevents the closure of the main switch to the closed position;

a hook sensing mechanism including a hook sensing pin movable between a disengaged hook position and an inserted hook position, wherein the hook sensing pin cooperates directly with the main switch and prevents the closure of the main switch to the closed position when in the disengaged hook position; and wherein the hook sensing mechanism further comprises:

a shaft rotatable relative to the casing about an axis and having at least one arm intended to contact with the hook during the insertion of the hook into the casing; and a transmission for controlling the movement of the hook sensing pin from the disengaged hook position to the inserted hook position as a function of the position of the shaft about the axis.

4. A door-lock according to claim 3, wherein the hook sensing mechanism further comprises an elastic element disposed between the hook sensing pin and the casing and that tends to push the hook sensing pin to the disengaged hook position.

5. A door-lock according to claim 3, wherein the shaft has an eccentric pin which engages a groove of the hook sensing pin.

6. A door-lock according to claim 3, wherein the at least one arm comprises a pair of radial arms adapted to contact the hook, the radial arms being located laterally on opposite sides of the cam.

* * * * *